US010743622B2

(12) United States Patent
Yeh

(10) Patent No.: US 10,743,622 B2
(45) Date of Patent: Aug. 18, 2020

(54) FOOTWEAR VENTILATION STRUCTURES AND METHODS

(71) Applicant: TBL Licensing LLC, Stratham, NH (US)

(72) Inventor: Thomas Yeh, Newmarket, NH (US)

(73) Assignee: TBL Licensing LLC, Stratham, NH (US)

( * ) Notice: Subject to any disclaimer, the term of this patent is extended or adjusted under 35 U.S.C. 154(b) by 151 days.

(21) Appl. No.: 15/176,517

(22) Filed: Jun. 8, 2016

(65) Prior Publication Data

US 2016/0353843 A1 Dec. 8, 2016

Related U.S. Application Data

(60) Provisional application No. 62/172,433, filed on Jun. 8, 2015.

(51) Int. Cl.

| | |
|---|---|
| ***A43C 13/14*** | (2006.01) |
| ***A43B 23/10*** | (2006.01) |
| ***A43B 7/08*** | (2006.01) |

(52) U.S. Cl.

CPC ..... *A43C 13/14* (2013.01); *A43B 7/08* (2013.01)

(58) Field of Classification Search

CPC .. A43B 7/08; A43B 7/06; A43B 7/081; A43B 7/082; A43B 7/084; A43B 7/085; A43B 7/125; A43B 7/12; A43B 19/00; A43B 23/07; A43B 23/08; A43B 23/081; A43B 23/082; A43B 23/083; A43B 23/085; A43B 23/086; A43B 23/087; A43B 23/26; A43B 23/10; A43C 13/14

USPC ..... 36/72 R, 77 R, 3 R, 3 A, 55, 77 M, 54, 36/126; D2/972

See application file for complete search history.

(56) References Cited

U.S. PATENT DOCUMENTS

| | | | |
|---|---|---|---|
| RE632 | E | 12/1858 | Mitchell |
| 26,329 | A | 11/1859 | Silverthorn |
| 27,918 | A | 4/1860 | McErren |
| 682,182 | A | 9/1901 | Ellings |
| 757,424 | A | 4/1904 | Vohl |
| 1,125,134 | A | 1/1915 | Lee |
| 1,211,542 | A | 1/1917 | Carolin |
| 1,213,941 | A | 1/1917 | Patrick |
| 1,335,273 | A | 3/1920 | Bruce |

(Continued)

FOREIGN PATENT DOCUMENTS

| | | |
|---|---|---|
| CN | 201790070 U | 4/2011 |
| DE | 9016134 | 2/1991 |

(Continued)

OTHER PUBLICATIONS

International Search Report for Application No. PCT/US2016/036455 dated Sep. 21, 2016.

(Continued)

*Primary Examiner* — Anna K Kinsaul
*Assistant Examiner* — F Griffin Hall
(74) *Attorney, Agent, or Firm* — Lerner, David, Littenberg, Krumholz & Mentlik, LLP

(57) ABSTRACT

Various embodiments of protective footwear are disclosed with improved ventilation characteristics. The protective footwear includes a toe cap having a ventilation channel, and various other ventilation structures to improve heat-transfer properties of the footwear.

20 Claims, 14 Drawing Sheets

(56) References Cited

U.S. PATENT DOCUMENTS

| | | | | | |
|---|---|---|---|---|---|
| 1,394,348 | A | * | 10/1921 | Pietrowski | A43B 7/06 36/3 A |
| 1,476,127 | A | | 12/1923 | Williams | |
| 1,902,780 | A | | 4/1930 | Holden et al. | |
| 1,872,025 | A | * | 8/1932 | Baynard | A43C 13/14 36/72 R |
| 1,885,327 | A | | 11/1932 | Burnham | |
| 2,300,681 | A | | 11/1942 | Margolin | |
| 2,437,065 | A | | 3/1948 | Austin | |
| 2,703,937 | A | | 3/1955 | McGinn | |
| 2,887,793 | A | | 5/1959 | Starr | |
| 2,966,684 | A | | 1/1961 | Bonin | |
| 3,044,188 | A | | 7/1962 | Evangelista | |
| 3,331,146 | A | | 7/1967 | Karras | |
| 3,481,055 | A | * | 12/1969 | Herman | A43B 1/14 36/126 |
| 4,137,653 | A | | 2/1979 | Famolare, Jr. | |
| 4,231,170 | A | * | 11/1980 | Griswold | A43B 3/16 36/72 R |
| 4,364,186 | A | | 12/1982 | Fukuoka | |
| 4,476,600 | A | | 10/1984 | Seidel et al. | |
| 4,485,568 | A | | 12/1984 | Landi et al. | |
| D287,065 | S | | 12/1986 | Austin | |
| 4,742,625 | A | | 5/1988 | Sydor et al. | |
| 5,014,363 | A | | 5/1991 | Hubner | |
| 5,044,096 | A | | 9/1991 | Polegato | |
| 5,086,572 | A | | 2/1992 | Lee | |
| 5,171,033 | A | * | 12/1992 | Olson | A43B 5/1675 280/11.202 |
| 5,295,312 | A | | 3/1994 | Blumberg et al. | |
| 5,339,545 | A | | 8/1994 | Paris | |
| 5,342,070 | A | * | 8/1994 | Miller | A43B 23/087 280/11.231 |
| 5,357,689 | A | | 10/1994 | Awai | |
| 5,365,677 | A | * | 11/1994 | Dalhgren | A43B 1/04 36/3 A |
| 5,511,323 | A | | 4/1996 | Dahlgren | |
| 5,526,584 | A | | 6/1996 | Bleimhofer et al. | |
| 5,551,172 | A | | 9/1996 | Yu | |
| 5,606,806 | A | | 3/1997 | O'Dwyer | |
| D389,996 | S | | 2/1998 | Sessa | |
| 5,799,413 | A | | 9/1998 | Argyris | |
| 5,809,665 | A | | 9/1998 | Suenaga | |
| 5,809,666 | A | | 9/1998 | Harwood | |
| 5,832,633 | A | | 11/1998 | Wang | |
| 5,860,225 | A | | 1/1999 | O'Dwyer | |
| 6,012,236 | A | | 1/2000 | Pozzobon et al. | |
| 6,014,823 | A | | 1/2000 | Lakic | |
| 6,018,819 | A | | 2/2000 | King et al. | |
| 6,228,477 | B1 | | 5/2001 | Klare et al. | |
| 6,367,170 | B1 | | 4/2002 | Williams | |
| 6,381,876 | B2 | | 5/2002 | Krajcir | |
| 6,410,084 | B1 | | 6/2002 | Klare et al. | |
| D473,046 | S | | 4/2003 | Schroeder et al. | |
| D473,705 | S | | 4/2003 | Nason | |
| 6,547,751 | B1 | | 4/2003 | Barberio et al. | |
| D485,020 | S | | 1/2004 | Yake et al. | |
| 6,676,993 | B2 | | 1/2004 | Klare | |
| D493,275 | S | | 7/2004 | Koyess et al. | |
| 6,811,112 | B1 | | 11/2004 | Berger et al. | |
| 6,854,603 | B2 | | 2/2005 | Klare | |
| D517,306 | S | | 3/2006 | Hoeft | |
| D522,223 | S | * | 6/2006 | Murphy | D2/972 |
| 7,730,640 | B2 | * | 6/2010 | Clark | A43B 7/125 36/113 |
| 7,818,895 | B2 | | 10/2010 | Boone et al. | |
| D669,667 | S | | 10/2012 | Sakurai | |
| 8,359,769 | B2 | * | 1/2013 | Vattes | A43B 17/08 36/3 A |
| 2002/0120977 | A1 | | 9/2002 | Smith | |
| 2004/0111918 | A1 | | 6/2004 | Van Noy et al. | |
| 2004/0221482 | A1 | | 11/2004 | Berger et al. | |
| 2005/0028405 | A1 | | 2/2005 | Wilson et al. | |
| 2012/0167418 | A1 | * | 7/2012 | Frappier | A43B 5/1675 36/115 |
| 2014/0033575 | A1 | * | 2/2014 | Cruikshank | A43B 23/26 36/116 |

FOREIGN PATENT DOCUMENTS

| | | | | |
|---|---|---|---|---|
| EP | 0350611 | | 1/1990 | |
| EP | 0353430 | | 2/1990 | |
| EP | 042 556 | | 5/1991 | |
| EP | 0458174 | | 11/1991 | |
| EP | 0732067 | | 9/1996 | |
| EP | 0800777 | | 10/1997 | |
| EP | 0910964 | | 12/2000 | |
| EP | 1118280 | | 1/2002 | |
| EP | 2220955 | A1 | 8/2010 | |
| EP | 2740379 | A1 | 6/2014 | |
| FR | 1310482 | | 11/1962 | |
| GB | 191514398 | | 2/1916 | |
| WO | 0051457 | | 9/2000 | |
| WO | 2008082449 | A2 | 7/2008 | |
| WO | WO-2015015477 | A1 * | 2/2015 | A43B 23/082 |

OTHER PUBLICATIONS

International Preliminary Report on Patentability for International Application PCT US 2016/036455 dated Dec. 21, 2017.

United States Design Patent D784,665, tilted "Toe Cap for Footwear," patented Apr. 25, 2017.

* cited by examiner

FOOTWEAR VENTILATION STRUCTURES AND METHODS

CROSS-REFERENCE TO RELATED APPLICATIONS

This application claims the benefit of the filing date of U.S. Provisional Patent Application No. 62/172,433, filed Jun. 8, 2015, which is related to U.S. Design Pat. application No. 29/529,466, filed on Jun. 8, 2015, the disclosures of which are hereby incorporated by reference herein.

BACKGROUND OF THE INVENTION

The present invention relates to articles of footwear, in particular articles of footwear having improved ventilation characteristics.

Certain types of safety footwear must satisfy particular requirements in order for the footwear to be designated as "protective footwear." For instance, the American Society for Testing and Materials (ASTM) sets standards for protecting consumer's toes and metatarsal areas in "protective footwear" (e.g., as set forth in ASTM F2413-11). If a safety toe cap is used, it must meet certain impact resistance and compression resistance tests, indicating the toe cap can sufficiently protect a user's foot from injury. The same is true for metatarsal guards utilized in such footwear.

While safety is a significant concern in these types of footwear, often the footwear lacks proper or efficient ventilation, making the footwear hot and uncomfortable during use. A need therefore exists for providing protective footwear with proper and effective ventilation.

BRIEF SUMMARY OF THE INVENTION

A first aspect of the present invention includes an article of footwear comprising an upper defining a cavity sized and shaped to receive a foot of a user, wherein the upper is attached to an outsole. The article of footwear also comprises a protective toe cap positioned under the upper and adjacent a toe region of the footwear, the toe cap being effective to protect a forefoot portion of the user's foot from injury and having an arcuate shape with a section arranged to overly toes of the user's foot during use, wherein the toe cap includes a ventilation channel for providing ventilation in the toe region. In an embodiment, the toe cap is hemi-domed in shape and the ventilation channel extends along a longitudinal axis of the toe cap. Further, the upper may include a tongue region and a ventilation channel that is positioned along the tongue region, the ventilation channel of the tongue being in communication with a heat egress port effective to allow heat to escape the ventilation channel.

A second aspect of the invention includes a protective toe cap for an article of footwear comprising a hemi-dome shaped body sized and shaped to cover a user's toes once incorporated into footwear, the body having inner and outer surfaces and a ventilation channel extending in a longitudinal direction between a forefoot side and a midfoot side of the body, the ventilation channel being open along the inner surface to allow air to travel along the ventilation channel. In an embodiment, the ventilation channel includes an inner surface that is offset from the inner surface of the body of the toe cap, and the inner surfaces of the ventilation channel and the toe cap converge in the direction of the forefoot side of the body. In another embodiment, the toe cap is rigid and has strength characteristics sufficient to satisfy ASTM F2413-11.

BRIEF DESCRIPTION OF THE DRAWINGS

A more complete appreciation of the subject matter of the present invention and the various advantages thereof can be realized by reference to the following detailed description in which reference is made to the accompanying drawings.

DETAILED DESCRIPTION

In describing embodiments of the invention discussed herein, specific terminology will be used for the sake of clarity. However, the invention is not intended to be limited to any specific terms used herein, and it is to be understood that each specific term includes all technical equivalents, which operate in a similar manner to accomplish a similar purpose.

The inventions disclosed herein include, in general, various types of protective footwear that utilize ventilation and/or safety structures to provide improved breathability and safety for a user of the footwear. As an example, the footwear disclosed herein utilizes an improved protective toe cap 20, as shown in FIGS. 1-5, along with various vents and/or heat channels to provide footwear 10 with effective protection for a user's toe area, as well as improved ventilation. Such footwear 10 may also use other protective structures, such as a metatarsal guard 70 that itself has vents or other mechanisms, for providing ventilation.

Figure 1:
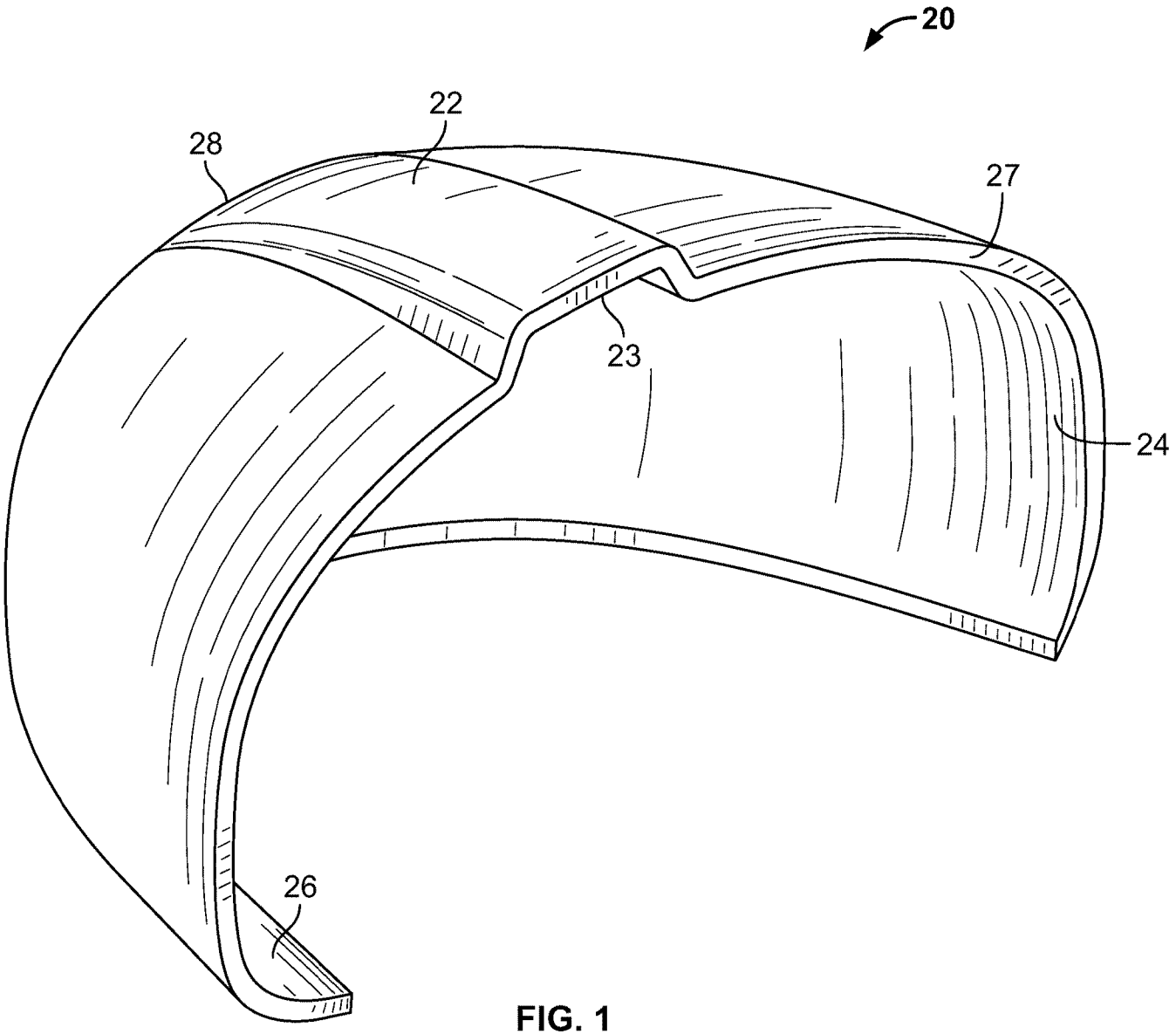
FIGS. 1-5 are perspective, back, front, left, and right views of a protective toe cap, in accordance with an embodiment of the invention.
Figure 2:
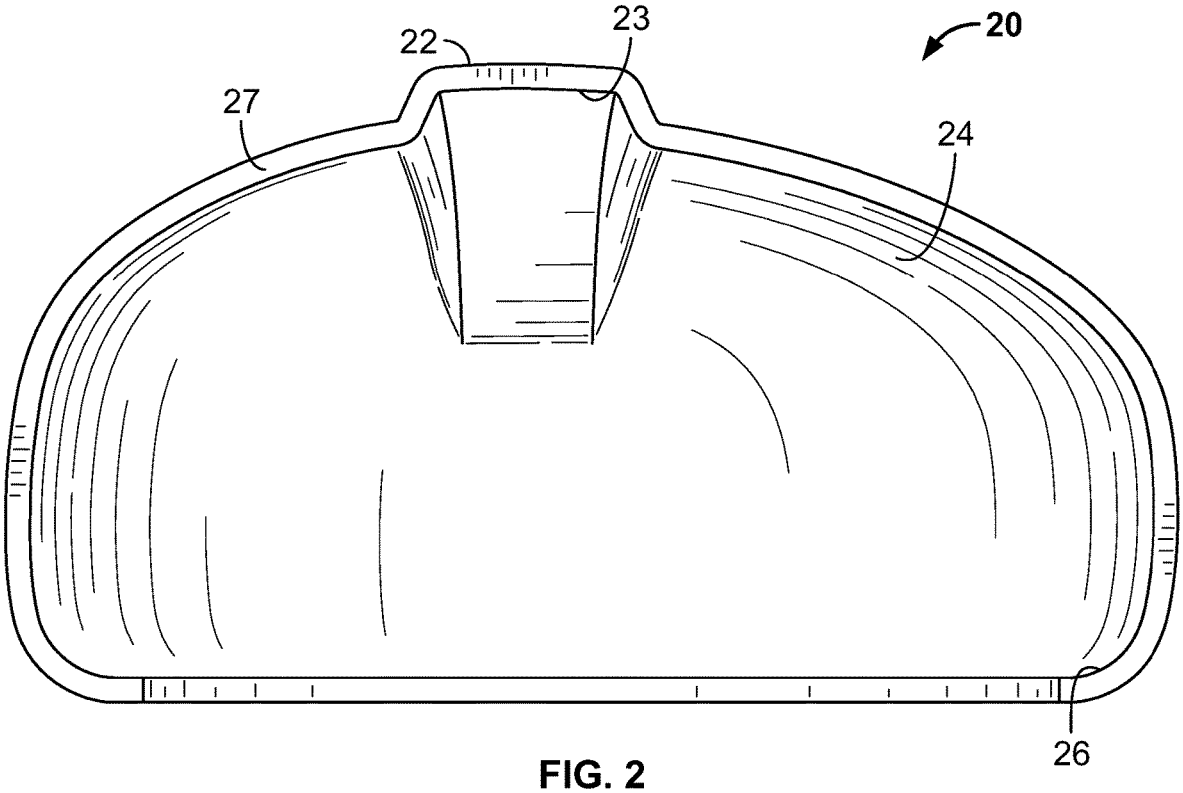
Figure 3:
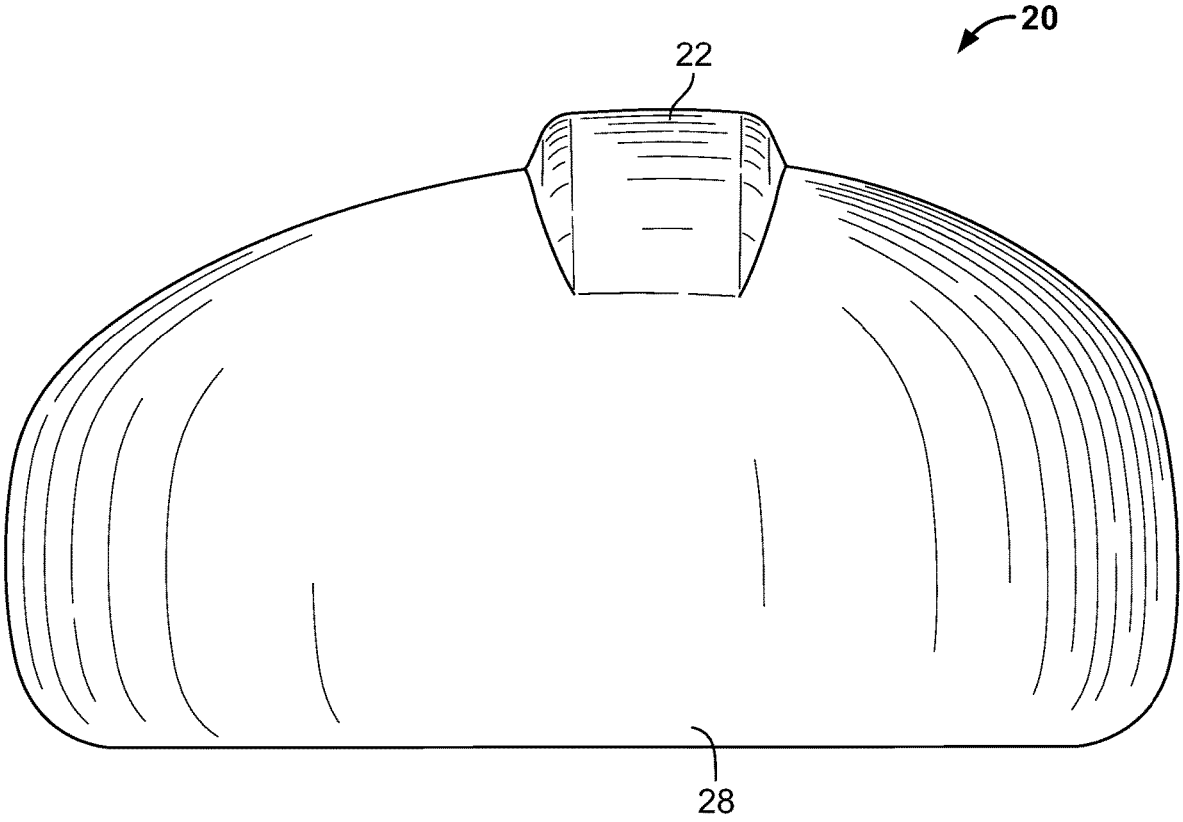
Figure 4:
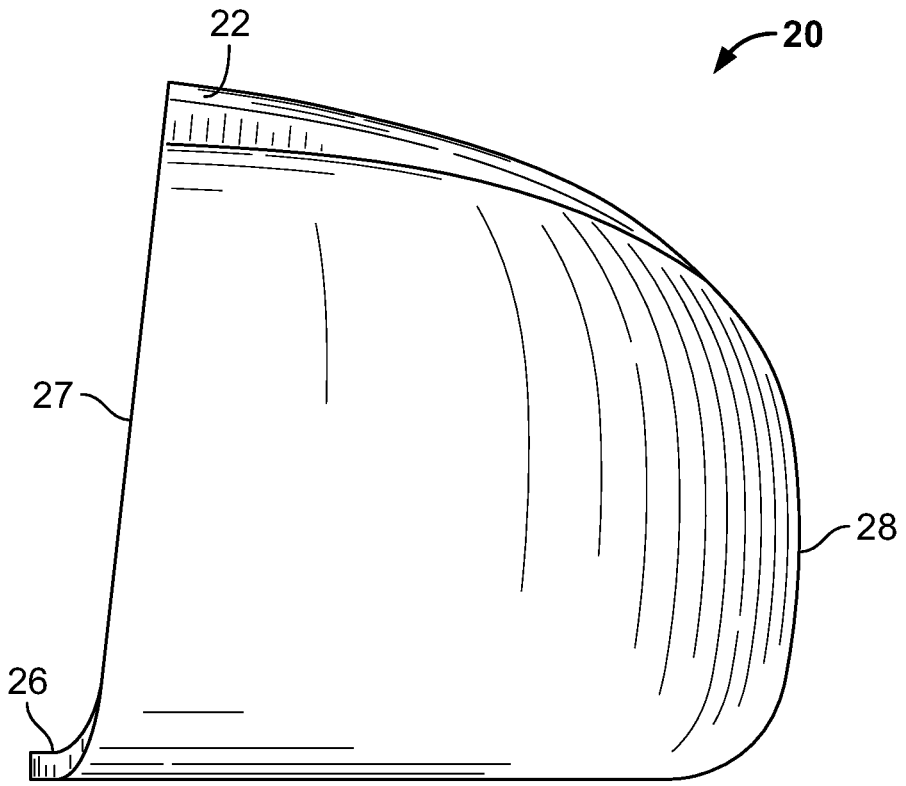
Figure 5:
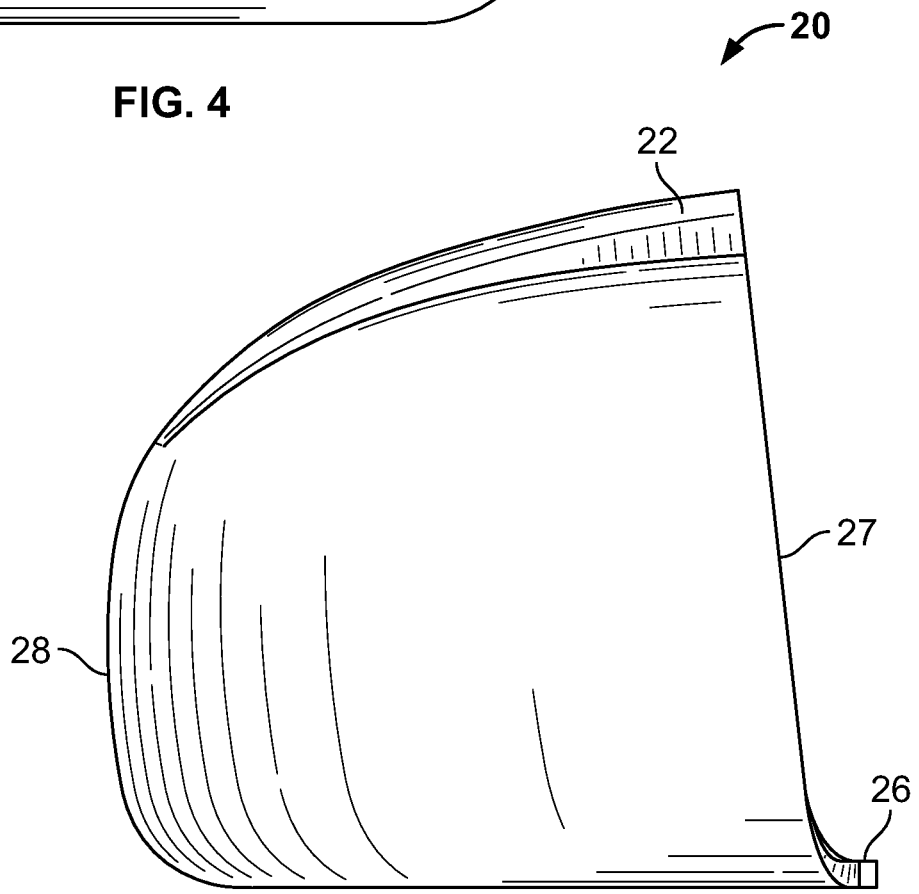

FIGS. 1-5 are various views of a toe cap 20, in accordance with an embodiment of the invention. Toe cap 20 is shaped to fully cover a user's toes and provide protection therefor. Thus, toe cap 20 is shaped as a hemi-dome in some embodiments. Toe cap 20 includes an open underside 24 sized to accommodate a user's toes, and has a protrusion 22 forming a ventilation channel 23 along underside 24. Although a single protrusion 22 is shown, multiple protrusions forming multiple ventilation channels are equally possible and contemplated by the present invention. Such protrusions may be arranged directly adjacent one another (e.g., in the center of toe cap 20), or may be spaced apart from each other (e.g., a protrusion substantially centered on toe cap 20, as shown in FIG. 1, and one or more protrusions along the sides of toe cap 20).

Protrusion 22 of FIGS. 1-5 extends from a midfoot side 27 of toe cap 20 towards a forefoot side 28 of toe cap 20 and tapers in the direction of forefoot side 28. As such, a height of channel 23 is at a maximum at midfoot side 27 of toe cap 20 and progressively decreases in the direction of forefoot side 28 until protrusion 22 and channel 23 disappear along underside 24 of toe cap 20. In an embodiment, protrusion 22 is shaped as a quadrangle, although it could be semi-circular, triangular, hexagonal, pentagonal, polygonal, or any other shape that adequately provides a ventilation channel 23.

Toe cap 20 also includes a lower lip 26 that extends around the perimeter of underside 24. Lip 26 may be positioned in footwear under a user's foot and be utilized for attaching toe cap 20 to such footwear, as described in more detail below. Toe cap 20 is, in an embodiment, composed of a metal or metal alloy material (e.g., titanium) or any other material of a sufficient strength to satisfy safety standards for protective footwear, such as ASTM F2413-11.

Toe cap 20 can be incorporated into a variety of different types of footwear, with or without additional ventilation characteristics, to allow for improved ventilation and breathability in the footwear. Various embodiments of such footwear are shown throughout in FIGS. 6-16 (with certain components of such footwear shown in isolation in those figures).

Figure 6:
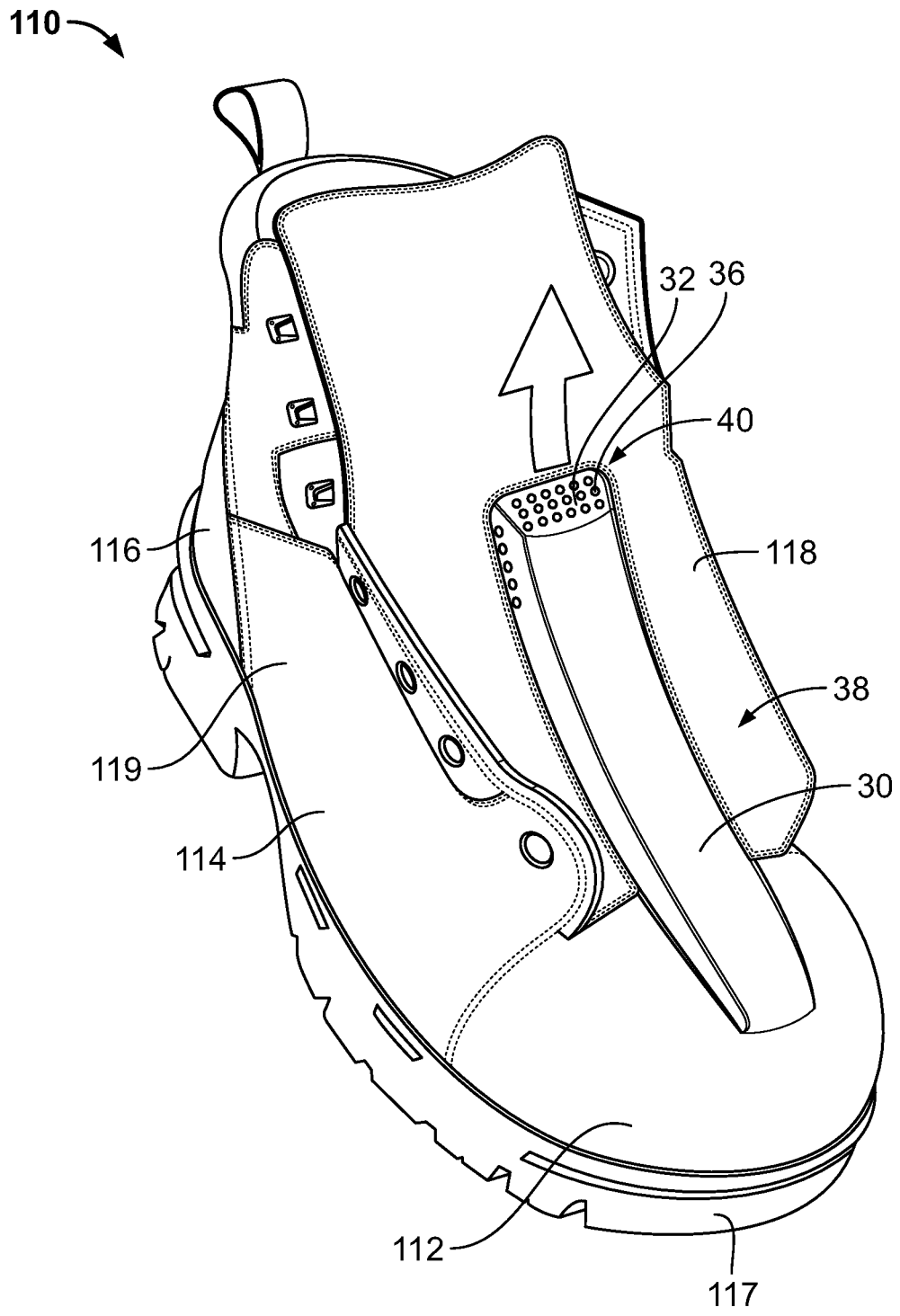
FIG. 6 is a perspective view of a shoe incorporating the toe cap of FIGS. 1-5 and having certain ventilation structures, in accordance with an embodiment of the invention.

Referring to FIGS. 6-10, different variations of footwear having ventilation structures in the tongue portion of the footwear are shown. For example, a first variant of footwear 110 is shown in FIG. 6. Footwear 110 includes all standard aspects of normal footwear, including but not limited to an outsole 117, an upper 119 attached to outsole 117, forefoot 112, arch 114, and heel 116 regions, and a tongue 118 forming part of upper 119. Although other common footwear components are not described in detail herein, footwear 110 includes such components as is apparent in the figures (e.g., laces, etc.)

Figure 9:
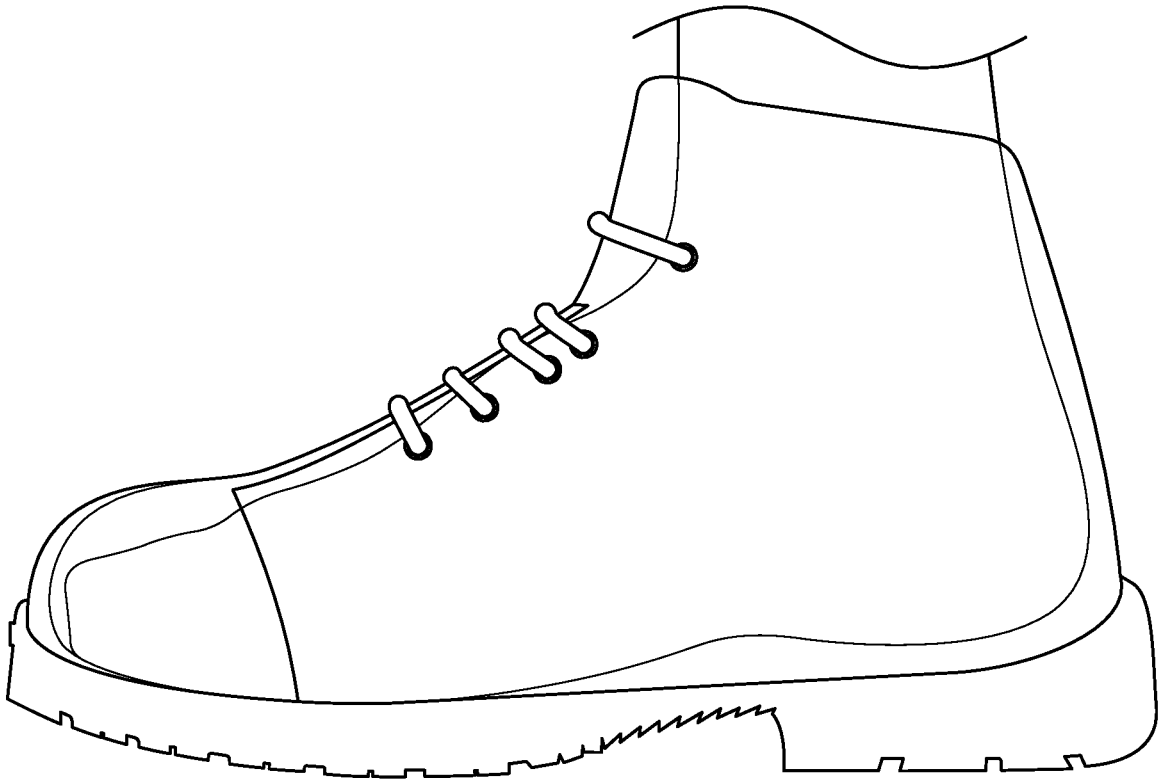
FIG. 9 is an exemplary cross-sectional view of the shoes of FIGS. 6-8 and 10.

Although not shown, footwear 110 also includes a toe cap 20 embedded within its forefoot region 112. Toe cap 20 is incorporated into the toe region of footwear 110 and is arranged with its lip 26 adjacent outsole 117 and its protrusion 22 positioned above the user's toes. Toe cap 20 may therefore provide protection for a user's toes against, for example, a falling object and also allow for improved ventilation via its protrusion 22 and ventilation channel 23. Further, tongue 118 of footwear 110 may also include an air vent channel 30 that, in an embodiment, forms a continuation of channel 23 of protrusion 22 of toe cap 20. Stated differently, tongue 118 may include an air vent channel 30 that extends longitudinally along tongue 118, and protrusion 22 may be shaped and sized to be positioned within vent channel 30 of tongue 118 so that a continuous air vent channel is formed along forefoot region 112 and arch region 114 of footwear 110. An example of a cross section showing such a continuous channel, and heat escaping from a user's foot through the channel, is shown in FIG. 9.

Referring again to FIG. 6, air vent channel 30 of tongue 118 terminates in a heat egress port 32 having a series of perforations 36 for allowing heat, moisture, etc. to escape channel 30. In this way, heat and/or moisture trapped in forefoot region 112 of footwear 110 may be allowed to escape through channel 23 of toe cap 20, into channel 30 of tongue 118 (which in an embodiment form a substantially continuous channel), and out of heat egress port 32. In some embodiments, although not shown, air vent channel 30 of tongue 118 may be open in the direction of a user's foot (e.g., like channel 23 of toe cap 20), or in other embodiments it may be closed by way of a mesh or other fabric covering vent channel 30. Meshes or other breathable fabrics may increase the comfort level of footwear 110 in the area of channel 30 of tongue 118 and channel 23 of toe cap 20. Indeed, to be clear, such meshes and fabrics as described above may extend over both channel 30 of tongue 118 and channel 23 of toe cap 20, in certain embodiments.

In another embodiment, air vent channel 30 may be formed on a leather overlay component 40 that is engaged with a leather underlay 38 attached under the eyestay quarter of footwear 110.

In use, footwear 110 may provide improved ventilation for safety/protective footwear by allowing heat to escape footwear 110 through channel 23 of toe cap 20, into air vent channel 30 of tongue 118, and out of heat egress port 32. In addition, toe cap 20 provides adequate safety for a user's toes and protects the toes from injury.

Figure 7:
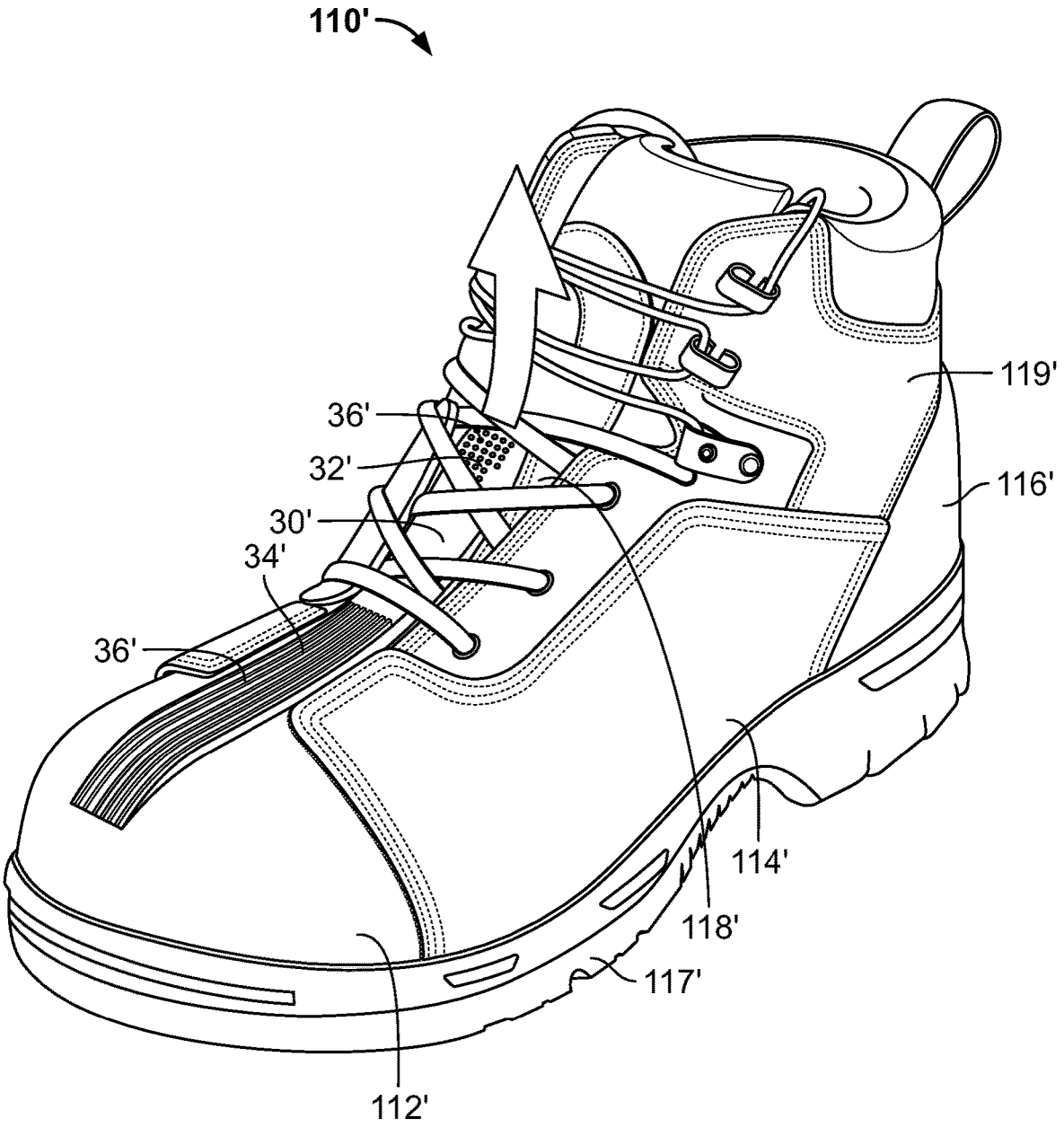
FIGS. 7-8 are perspective views of different variations of the shoe of FIG. 6 with additional ventilation characteristics.

A second variant of footwear 110' is shown in FIG. 7. Due to the similarities between footwear 110 of FIG. 6 and footwear 110' of FIG. 7, like reference numerals refer to like elements in this embodiment (although a prime designation is added to the reference numerals of FIG. 7), and predominantly the differences between footwear 110, 110' are discussed below.

Footwear 110' is different from footwear 110 in that footwear 110', in addition to having a heat egress port 32', also includes an air ingress port 34'. Air ingress port 34' is composed of a series of perforations 36', in an embodiment, and it allows air to flow into channel 30' of tongue 118', through channel 30', and subsequently out of heat egress port 32'. During this process, heat from the user's toes may also circulate or travel through channel 23 of toe cap 20 and into channel 30' of tongue 118'. Thus, heat from the user's toes may combine with cooler air from the environment, which accesses channel 30' through air ingress port 34', and ultimately the combined cooler air from the environment and hotter air from the user's toes may exit through heat egress port 32'. In this way, footwear 110' provides additional ventilation characteristics as compared to footwear 110. Further, although not described above, it is contemplated that footwear 110' may include any of the features of footwear 110 (e.g., meshes or fabric over channel 30', an open channel 30' facing the user's foot, toe cap 20 within footwear 110', etc.)

Figure 8:
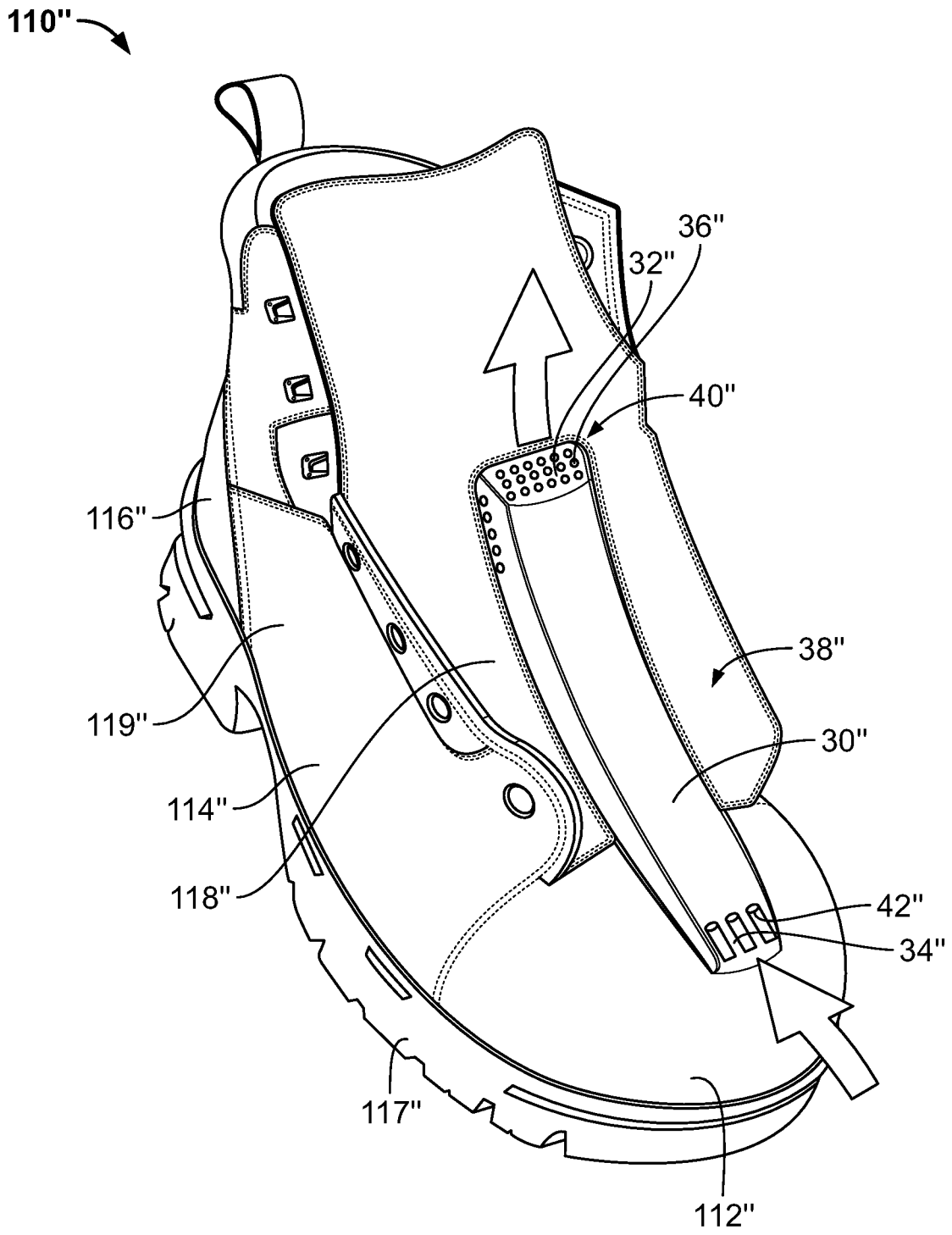
Figure 10:
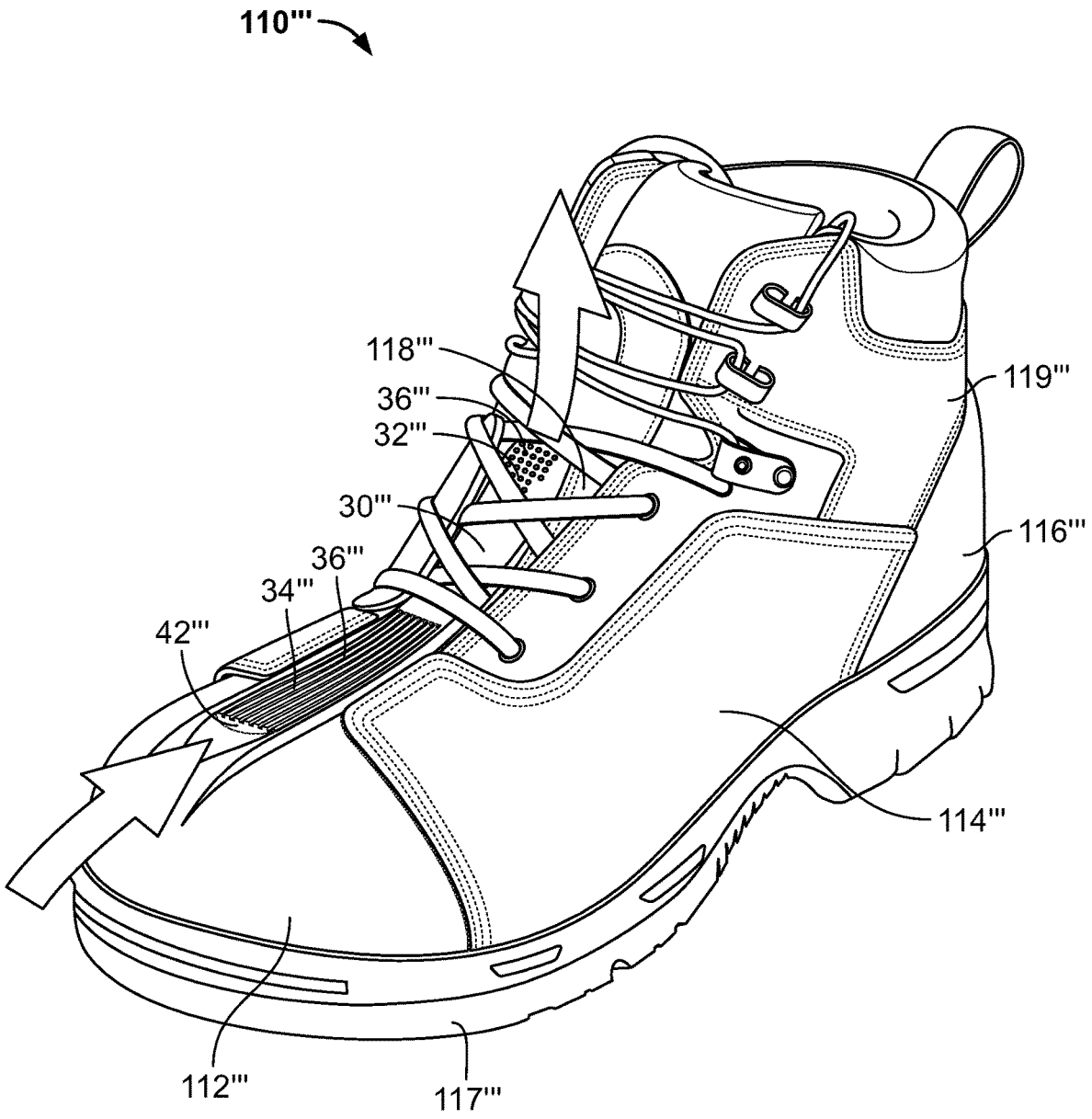
FIG. 10 is a perspective view of a different variation of the shoe of FIG. 6 with additional ventilation characteristics.

Third and fourth variants of footwear 110", 110'" are shown in FIGS. 8 and 10. Due to the similarities between the previous variants and footwear 110", 110'", like reference numerals refer to like elements in this embodiment (although additional prime designations are added to the reference numerals of FIGS. 8 and 10), and predominantly the differences between each variant is discussed below.

Footwear 110", 110'" each include an air ingress port 34", 34'", but such ports are constructed differently than ingress port 34' of the previous embodiment. As an example, air ingress port 34" of footwear 110" of FIG. 8 includes a series of openings 42" that define air ingress port 34". In addition, besides openings 42", channel 30" of tongue 118" is closed in an outward direction along tongue 118" until heat egress port 32" is reached. As to air ingress port 34'" of footwear 110'", it includes a single opening 42'" as well as perforations 36'" along part of the length of tongue 118'". Although not described above, here as well footwear 110", 110'" may include any of the features of footwear 110, 110' described previously such as, for example, an open channel 30", 30'" in the direction of the user's foot, a channel 30", 30'"

covered by a mesh or breathable fabric, toe cap 20 within footwear 110", 110'", and/or other features not explicitly detailed here.

Figure 11:
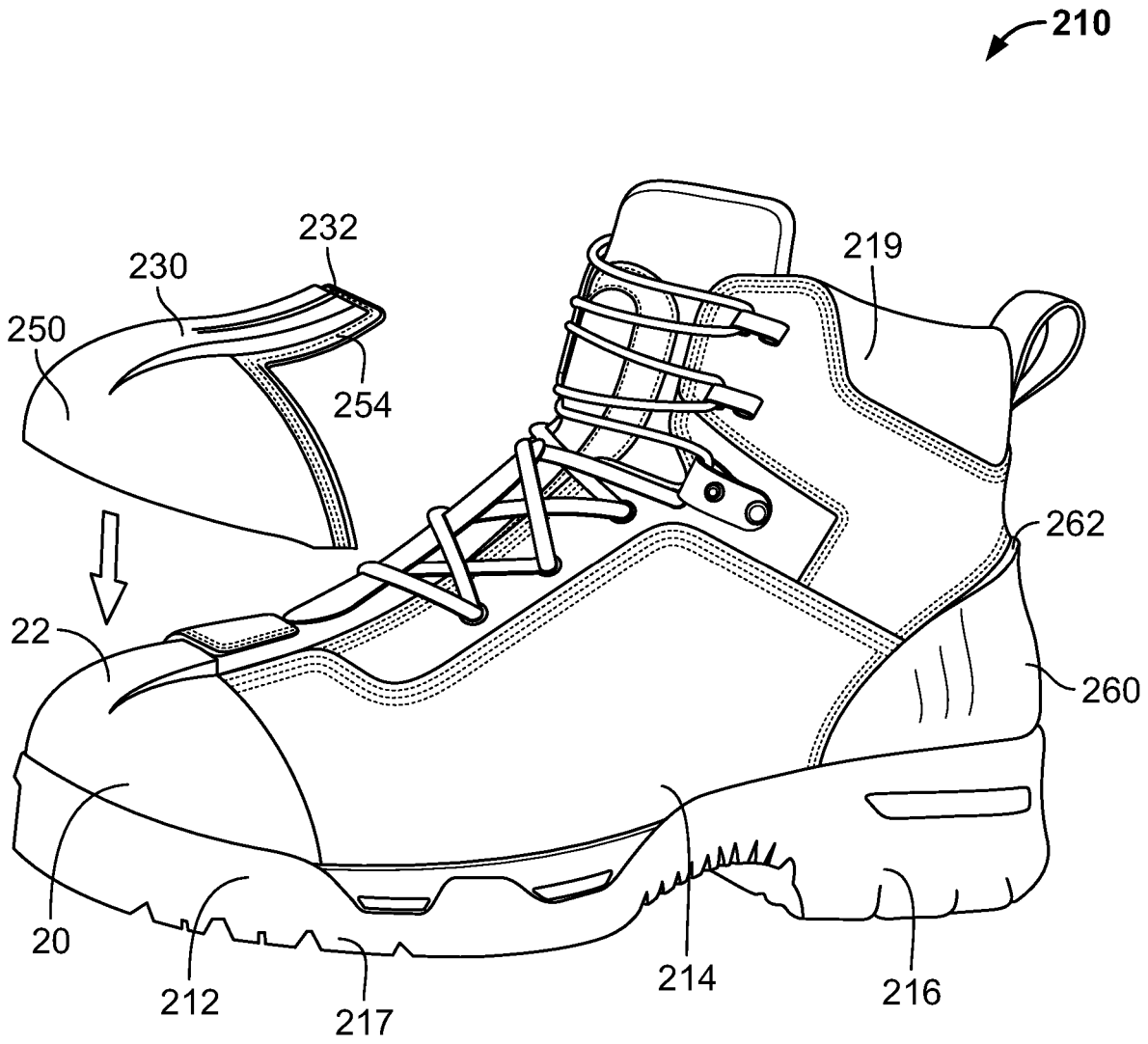
FIG. 11 is an exploded perspective view of a shoe incorporating the toe cap of FIGS. 1-5 and having a rubber housing therefor, in accordance with another embodiment of the invention.

FIG. 11 depicts footwear 210, according to another embodiment of the invention. Due to the similarities between the previous variants of footwear and footwear 210, like reference numerals refer to like elements in this embodiment (although in the 200-series of numbers), and predominantly the differences between each footwear embodiment is discussed below.

Footwear 210 includes toe cap 20, as with each of the previous embodiments. Toe cap 20 is shown in detail in the exploded view of FIG. 11. Positioned over toe cap 20, however, is a housing 250, optionally composed of a rubber material for waterproofing purposes. Housing 250 has a protrusion forming an air vent channel 230 that matches the shape of protrusion 22 of toe cap 20 and is sized to receive protrusion 22 of toe cap 20. Additionally, protrusion 230 has an extension part 254 that leads to a heat egress port 232. Heat egress port 232 is clearly shown in the top view of FIG. 13. As illustrated, heat egress port 232 may comprise an opening that is covered by a mesh or other breathable fabric to allow heat to escape port 232. Further, as with the previous embodiments, air vent channel 230 may be open in the direction of the user's foot or it may be covered by a mesh or other breathable fabric to allow heat to enter channel 230 and exit footwear 210 via heat egress port 232.

Figure 12:
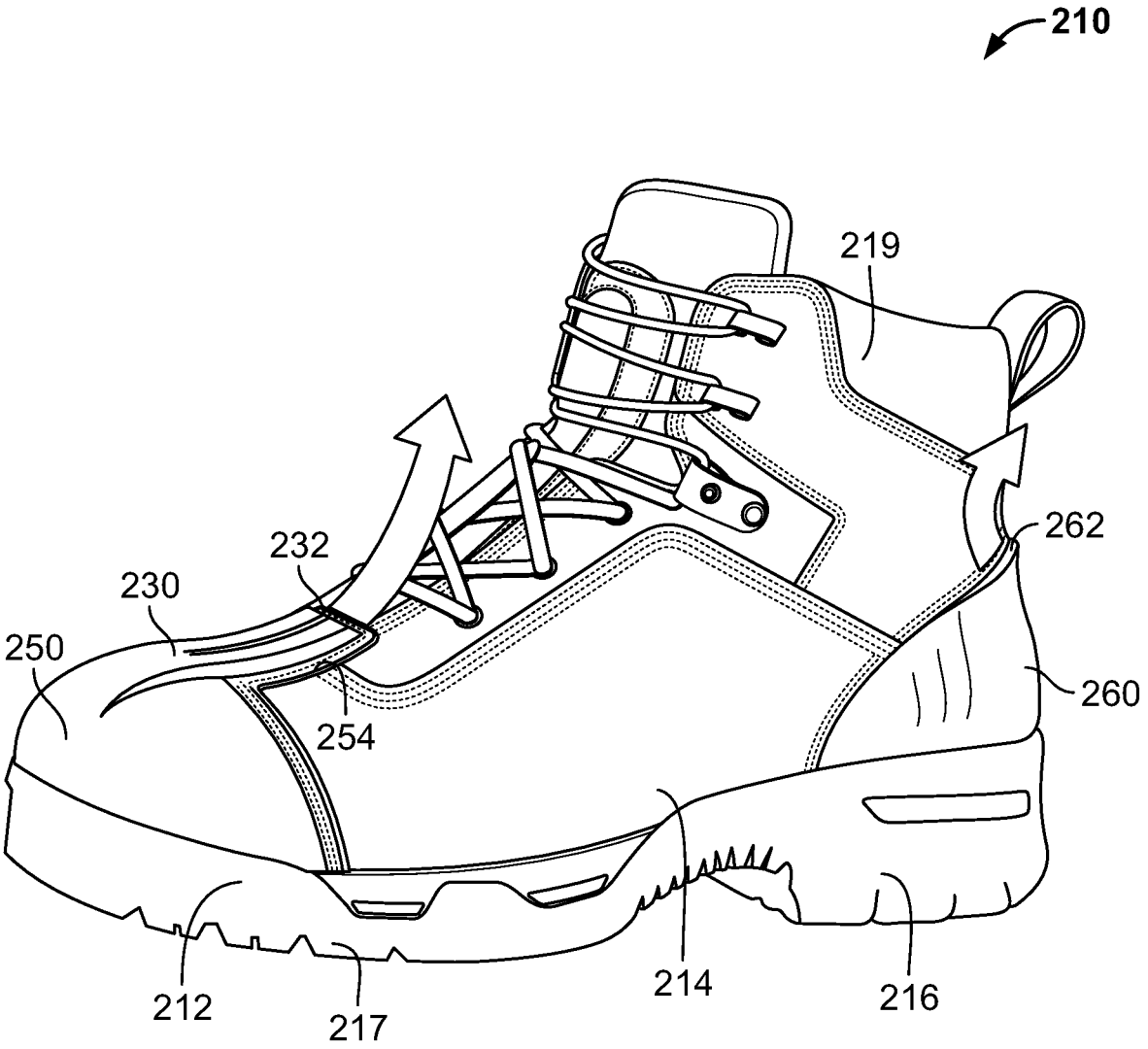
FIG. 12 is an assembled perspective view of the shoe of FIG. 11.
Figure 13:
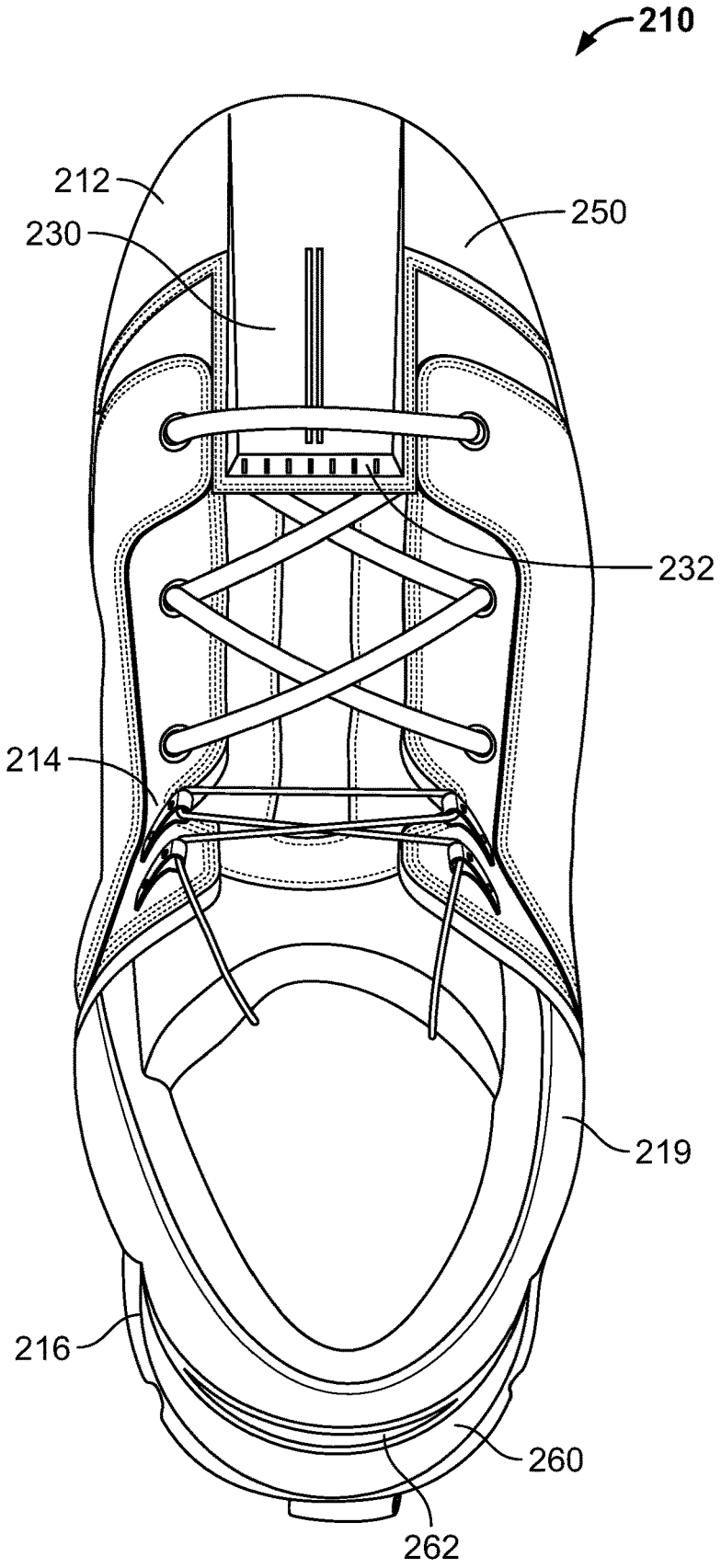
FIG. 13 is a top view of the shoe of FIG. 11.

Footwear 210 may also include a heel counter 260 that has its own heat egress port 262 for allowing heat to escape from heel region 216 of footwear 210. As shown in FIGS. 12-13, heat egress port 262 may extend circumferentially around a majority of heel region 216 of footwear 210 to provide adequate ventilation.

Toe cap 20 of footwear 210 provides sufficient safety protection during use, along with ventilation via its channel 23, rubber housing 250 provides additional safety protection in addition to waterproofing characteristics, and heat egress port 262 of heel counter 260 allows for ventilation in heel region 216 of footwear 210. Such ventilation and safety structures provide for improved safety footwear 210 with efficient ventilation to keep a user's foot comfortable during use.

Figure 14:
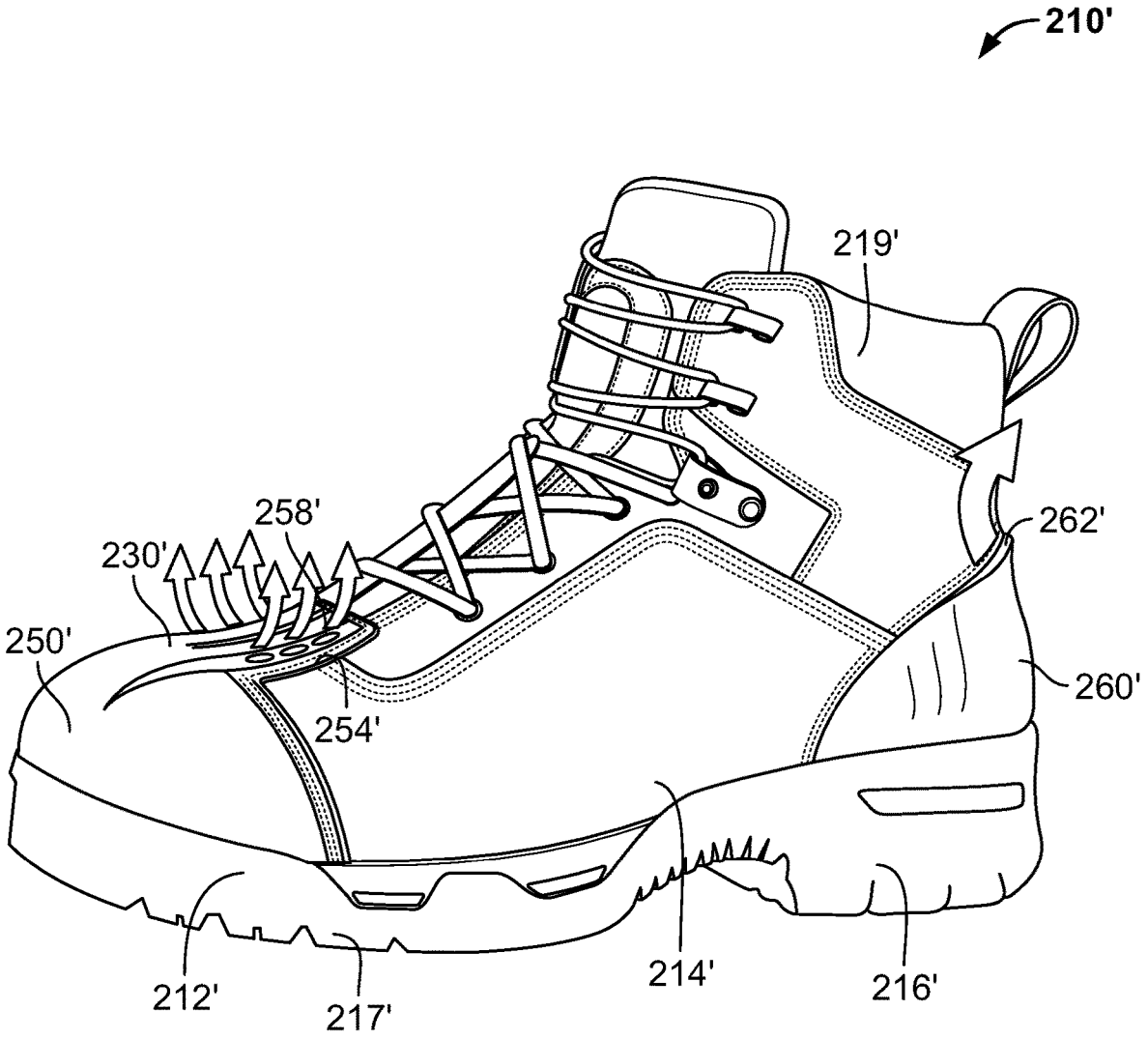
FIG. 14 is a perspective view of a variation of the shoe of FIGS. 11-13.

A variant of the previous embodiment, footwear 210', is shown in FIG. 14. Footwear 210' includes one or more side or lateral vents 258' positioned on one or both sides of air vent channel 230' of housing 250' (e.g., to provide for lateral air ventilation out of channel 230'). Footwear 210' may also include a heat egress port 232' or it optionally may be closed and not include such a port, as shown in FIG. 14. Apart from these modifications, footwear 210' is the same as footwear 210, and thus, like reference numerals refer to like elements in this embodiment (although a prime designation is added to the reference numerals of FIG. 14). Of course, footwear 210' may include all of the features of footwear 210 of the previous embodiment, although not specifically discussed herein.

Figure 15:
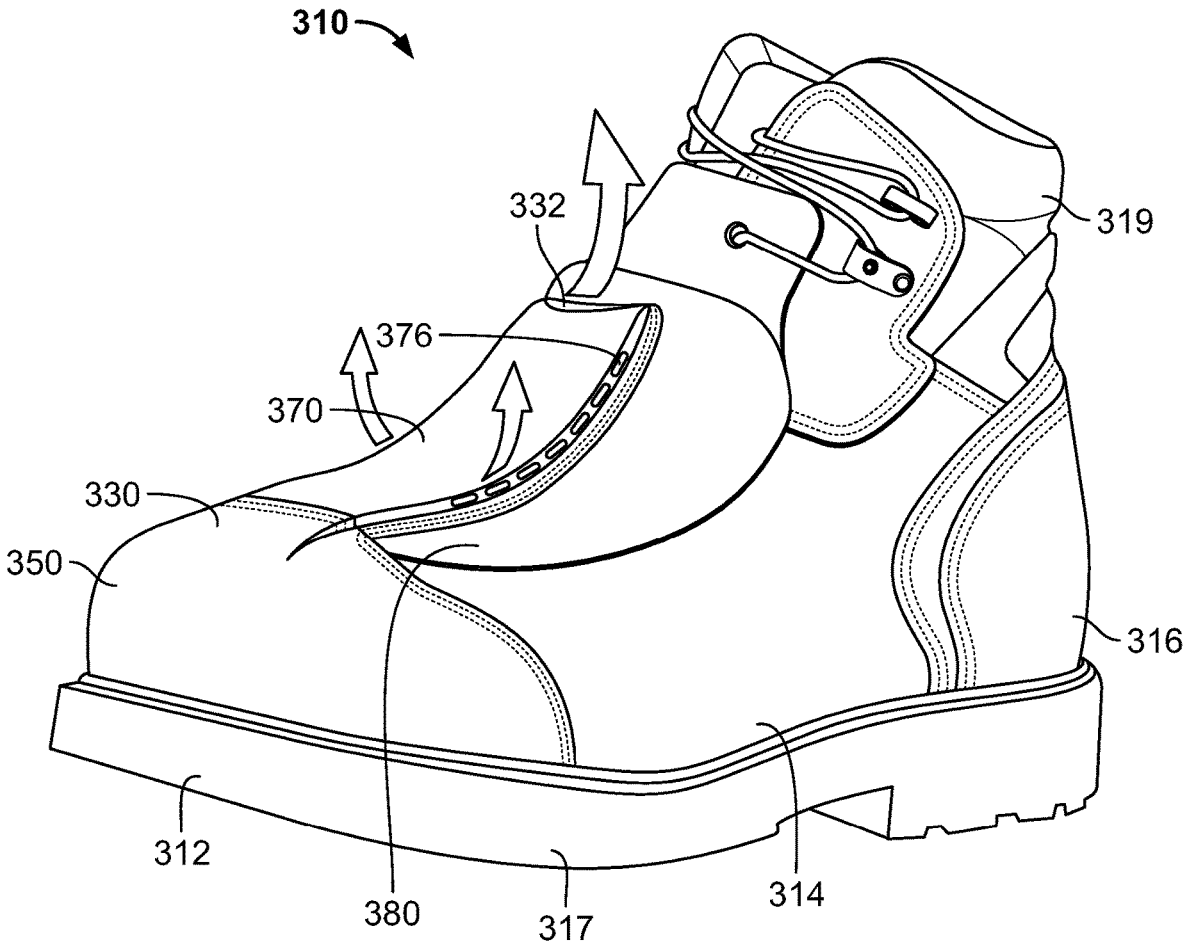
FIG. 15 is a perspective view of a shoe incorporating the toe cap of FIGS. 1-5, in which the shoe also utilizes a metatarsal guard with additional ventilation structures, in accordance with yet another embodiment of the invention.

FIG. 15 depicts footwear 310, according to yet another embodiment of the invention. Due to the similarities between the previous variants of footwear and footwear 310, like reference numerals refer to like elements in this embodiment (although in the 300-series of numbers), and predominantly the differences between each footwear embodiment are discussed below.

Figure 16:
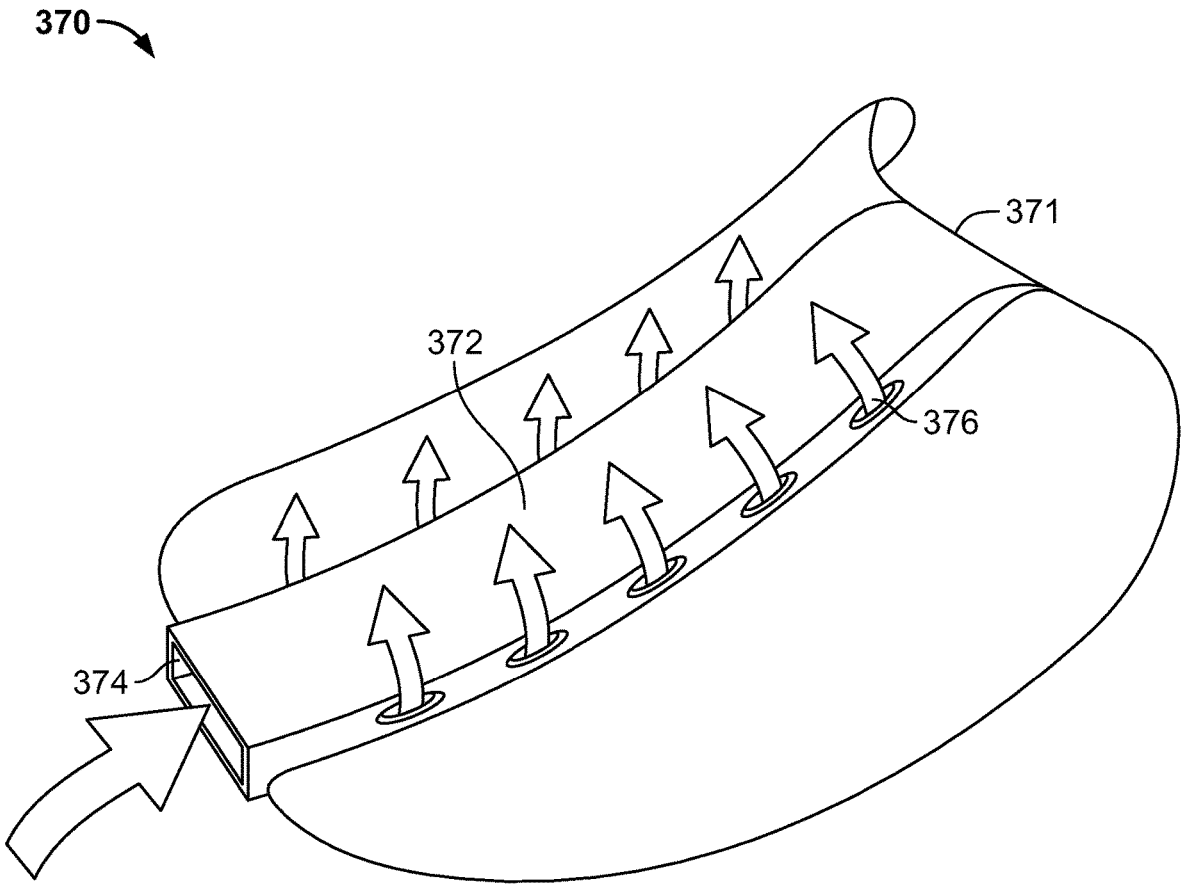
FIG. 16 is a perspective view of a metatarsal guard with vents, according to an embodiment of the invention.

Footwear 310 is different from previous embodiments in that, although toe cap 20 is used as in all embodiments, the ventilation structure of footwear 310 is incorporated into a metatarsal guard 370 component. A particular embodiment of a metatarsal guard 370 is shown in FIG. 16. As illustrated, metatarsal guard 370 may include an enclosed ventilation channel 372 with an opening 374 on a forefoot side of channel 372 and one or more lateral vents 376 in channel 372. Lateral vents 376 may extend along one or both sides of channel 372. For instance, in the embodiment shown in FIG. 15, lateral vents 376 extend along only a single side of channel 372, while in the embodiment of FIG. 16 lateral vents 376 extend along both sides. Ventilation channel 372 may also be closed at a midfoot side of channel 372, as shown in FIG. 16. Further, an inside surface 371 of metatarsal guard 370 is shaped to overlie and protect the metatarsal region of a user's foot during use (e.g., from injury due to a falling object). Thus, metatarsal guard 370 has a saddle-shaped inside surface 371 that is convex in a longitudinal direction and concave in a lateral direction.

Metatarsal guard 370 may be incorporated into a flap or pocket 380 of footwear 310, as shown in FIG. 15. As noted above, however, FIG. 15 depicts an embodiment of metatarsal guard 370 where ventilation channel 372 has vents 376 along only one side of channel 372. Metatarsal guard 370 is positioned within pocket 380, and acts to provide ventilation for the foot as well as protect the metatarsal area of the foot from injury. Although only referenced obliquely in FIG. 15 (and not shown), footwear 310 may also have a heat egress port 332 in pocket 380 that allows for further ventilation.

Metatarsal guard 370 may also include any of the protective features and/or patterns disclosed in Applicant's U.S. Pat. No. 8,635,789, directed to various metatarsal guards, which is hereby incorporated by reference herein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will also be appreciated that the various dependent claims and the features set forth therein can be combined in different ways than presented in the initial claims. In particular, it is to be appreciated that any feature of any dependent claim may be shared with another independent or dependent claim, to the extent technologically feasible, as if the claims were written in multiple dependent form. It will also be appreciated that the features described in connection with individual embodiments may be shared with others of the described embodiments.

The invention claimed is:

1. An article of footwear comprising: an upper defining a cavity sized and shaped to receive a foot of a user, wherein the upper is attached to an outsole; and a protective toe cap positioned entirely under the upper and adjacent a toe region of the footwear, the protective toe cap having an open underside sized to accommodate toes of the user, a lower lip that extends along a perimeter of the open underside, a forefoot side, and a midfoot side, the lower lip being arranged adjacent to the outsole, the toe cap being effective to protect a forefoot portion of the user's foot from injury and having an arcuate shape with a section arranged to overly the toes of the user's foot during use, wherein the toe cap includes a ventilation channel for providing ventilation in the toe region, the ventilation channel defined in a protrusion extending from the midfoot side to the forefoot side, the protrusion having a height at a maximum at the midfoot side and decreasing in a direction of the forefoot; wherein the toe cap is hemi-domed in shape and the ventilation channel extends along a longitudinal axis of the toe cap from the toe region of the footwear towards a heel region of the footwear.

2. An article of footwear as claimed in claim 1, wherein the toe cap includes inner and outer surfaces, the inner surface comprising the open underside, and the ventilation channel is open along the inner surface of the toe cap.

3. An article of footwear as claimed in claim 1, wherein the toe cap includes multiple ventilation channels.

4. An article of footwear, comprising: an upper defining a cavity sized and shaped to receive a foot of a user, wherein the upper is attached to an outsole; and a protective toe cap positioned adjacent a toe region of the footwear and entirely under the upper, the protective toe cap having an open underside sized to accommodate toes of the user, a lower lip that extends along a perimeter of the open underside, a forefoot side, and a midfoot side, the lower lip being arranged adjacent to the outsole, the toe cap being effective to protect a forefoot portion of the user's foot from injury and having an arcuate shape with a section arranged to overly the toes of the user's foot during use, wherein the toe cap includes a ventilation channel for providing ventilation in the toe region, the ventilation channel defined in a protrusion extending from the midfoot side to the forefoot side, the protrusion having a height at a maximum at the midfoot side and decreasing in a direction of the forefoot; wherein the upper includes a tongue region and a tongue ventilation channel is positioned along the tongue region, the tongue ventilation channel being aligned with the ventilation channel of the toe cap to provide a continuous channel.

5. An article of footwear as claimed in claim 4, wherein the ventilation channel of the tongue is in communication with a heat egress port effective to allow heat to escape the ventilation channel.

6. An article of footwear as claimed in claim 5, wherein the ventilation channel of the tongue is open along a first side of the ventilation channel arranged to face the user's foot and is closed along a second side of the ventilation channel arranged to face away from the user's foot.

7. An article of footwear as claimed in claim 5, wherein the ventilation channel of the tongue is in communication with an air intake port positioned adjacent a forefoot region of the footwear.

8. An article of footwear as claimed in claim 4, wherein the ventilation channel of the tongue extends along a majority of the length of the tongue.

9. An article of footwear as claimed in claim 4, wherein the ventilation channel of the tongue is aligned with the ventilation channel of the toe cap to provide the continuous ventilation channel extending from a forefoot region of the footwear to an arch region of the footwear.

10. An article of footwear as claimed in claim 1, wherein a waterproof housing is positioned over the protective toe cap, the waterproof housing providing waterproofing in a forefoot region of the footwear.

11. An article of footwear as claimed in claim 10, wherein the waterproof housing includes a ventilation channel having a heat egress port for providing ventilation in the forefoot region.

12. An article of footwear as claimed in claim 10, wherein the waterproof housing includes a lateral vent along a side of its ventilation channel to provide further ventilation in the forefoot region.

13. An article of footwear as claimed in claim 1, further comprising a metatarsal guard having a ventilation channel extending along a longitudinal axis of the footwear, wherein the ventilation channel of the metatarsal guard has a lateral vent to allow heat to escape the ventilation channel.

14. An article of footwear as claimed in claim 13, wherein the ventilation channel of the metatarsal guard is defined by first and second sides, and multiple lateral vents are formed in the ventilation channel along the first and second sides.

15. A protective toe cap for an article of footwear comprising: a hemi-dome shaped body sized and shaped to cover a users toes once incorporated entirely under an upper of a footwear, the body having inner and outer surfaces, a lower lip extending along a perimeter of the body, a forefoot side, a midfoot side, and a ventilation channel extending in a longitudinal direction between the forefoot side and the midfoot side of the body, the lower lip being configured to attach the protective toe cap to a sole portion of the article of footwear, the ventilation channel being open along the inner surface to air to travel along the ventilation channel and defined in a protrusion extending from the midfoot side to the forefoot side, the protrusion having a height at a maximum at the midfoot side and decreasing in a direction of the forefoot side.

16. A protective toe cap as claimed in claim 15, wherein the ventilation channel defines an opening at the forefoot side of the body.

17. A protective toe cap as claimed in claim 15, wherein the ventilation channel includes an inner surface that is offset from the inner surface of the body of the toe cap, and the inner surfaces of the ventilation channel and the toe cap converge in the direction of the forefoot side of the body.

18. A protective toe cap as claimed in claim 15, wherein the toe cap is rigid and has strength characteristics sufficient to satisfy ASTM F2413-11.

19. A protective toe cap as claimed in claim 15, wherein the toe cap includes multiple ventilation channels.

20. The article of footwear as claimed in claim 1, wherein the ventilation channel is arranged under the upper.

* * * * *